US005525042A

United States Patent [19]

Batten

[11] Patent Number: 5,525,042

[45] Date of Patent: Jun. 11, 1996

[54] LIQUID PUMP WITH COMPRESSED GAS MOTIVE FLUID

[75] Inventor: William C. Batten, Asheboro, N.C.

[73] Assignee: Clearline Systems, Inc., Asheboro, N.C.

[21] Appl. No.: 149,182

[22] Filed: Nov. 8, 1993

[51] Int. Cl.[6] ..... F04F 1/06; F04F 1/10

[52] U.S. Cl. ..... 417/118; 417/120; 417/129

[58] Field of Search ..... 417/118, 120, 417/126, 129, 136, 137, 138; 137/554, 236.1, 209

[56] References Cited

U.S. PATENT DOCUMENTS

| | | | |
|---|---|---|---|
| 49,063 | 8/1865 | Atwater | 417/118 |
| 1,044,511 | 11/1912 | Fountain | 417/118 |
| 2,764,104 | 9/1956 | Yeomans | 417/120 |
| 3,253,547 | 5/1966 | Weis | 417/120 |
| 3,299,832 | 1/1967 | Milne . | |
| 3,369,703 | 2/1968 | Reese . | |
| 3,915,593 | 10/1975 | Chamberlain . | |
| 4,184,506 | 1/1980 | Varis et al. | 417/120 |
| 4,235,726 | 11/1980 | Shimko . | |
| 4,268,396 | 5/1981 | Lowe . | |
| 4,527,633 | 7/1985 | McLaughlin . | |
| 4,625,801 | 12/1986 | McLaughlin . | |
| 5,004,405 | 4/1991 | Breslin . | |
| 5,011,376 | 4/1991 | Henriksson et al. | 417/120 |

FOREIGN PATENT DOCUMENTS

| | | | |
|---|---|---|---|
| 817104 | 10/1936 | France | 417/120 |
| 853192 | 8/1981 | U.S.S.R. | 417/118 |
| 2070694 | 9/1981 | United Kingdom | 417/120 |
| 1598068 | 9/1981 | United Kingdom | 417/118 |

*Primary Examiner* Michael Koczo
*Assistant Examiner* Roland G. McAndrews, Jr.
*Attorney, Agent, or Firm* Rhodes, Coats & Bennett

[57] ABSTRACT

An apparatus for pumping liquids to a destination includes a pipe of a first cross-sectional area extending from the liquid to be pumped to the destination. A body having a cross-sectional area less than twice the first cross-sectional area also has an upper portion, a lower portion, an inlet in the upper portion and an outlet to the pipe in the lower portion, a gas injection port, and a normally open valve between the gas injection port and the inlet, closeable upon an injection of gas through the gas injection port. Gas injection apparatus injects gas through the gas injection port from time to time. When no gas is being injected, liquid may enter the upper portion of the body through the inlet and fall by gravity toward the outlet in the lower portion and the pipe. Upon injection of gas, the valve closes, trapping liquid in the body below the valve, and trapped liquid is forced out the outlet and into the pipe toward the destination.

35 Claims, 4 Drawing Sheets

LIQUID PUMP WITH COMPRESSED GAS MOTIVE FLUID

BACKGROUND OF THE INVENTION

The present invention relates to improvements in pumps for liquids, particularly for pumps useful for pumping in difficult situations.

A primary application of the present invention relates to pumping an oil/grease component from effluent from kitchens. Typical modern restaurant kitchens produce a large volume of waste water containing various components in addition to water. These components include, food solids and, of particular concern, oils and greases. Oils and greases cause problems in sewage treatment plants so that the sewage treatment authorities encourage, and often require, that these components, generally referred to herein as "oil/grease," be removed from the effluent. In addition, these removed oil/grease components can be useful if separated from the water promptly before the oil/grease components become rancid.

Various devices have been disclosed for removing oil/grease from kitchen waste, such as those shown in U.S. Pat. No. 4,268,396 to Lowe and U.S. Pat. No. 4,235,726 to Shimko. Also, well known in this industry are the commercial products of the Lowe Engineering Company of Uncoln Park, N.J. and Thermaco, Inc. of Asheboro, N.C. These products generally operate by passing an oleophilic planar surface through the top surface of the oil/grease resting on a body of relatively still effluent. The oil/grease, having risen to the top of the still effluent, adheres to the oleophilic surface and can be scraped off.

However, there are still problems of solids floating of the surface which can interfere with the operation of the oleophilic surface and the scraper. Also, the throughput capacity of the prior art devices is somewhat limited, since the amount of oil/grease which can be removed by a given oleophilic surface is limited.

Furthermore, the oil/grease scraped from the oleophilic surface sometimes congeals and clogs the downstream piping. Accordingly, it would be helpful if positive pumping could be achieved, although conventional pumps can also be defeated by such congealed oil/grease.

Applicant's invention provides a pump that addresses these needs and also provides for an improved pump of general application having certain advantages.

Prior pumps of various designs can be defeated by attempting to pump liquids which contain the congealed or other solid matter, and the present invention provides a pump which does not suffer from these deficiencies.

Also, when pumping corrosive or hazardous liquids, in the past, there's been the problem of residual liquid remaining in the pump after a pumping session. The residual liquid remaining in the pump, acts as a reservoir of the hazardous or corrosive liquid, and is thus also contaminated.

Also, most prior pumps have required numerous moving parts, causing them to be expensive to manufacture and difficult to maintain. The present invention is not saddled with these drawbacks.

Also, typically the prior art pumps are of the substantial size, so that they are difficult to fit into small spaces from which it is desired to pump liquid. The present invention provides a pump which can be made small enough to be of virtually the same diameter as the liquid conveying line to be used with the pump, so that it can be used in such circumstances.

Finally, the present invention can be operated in a mode to provide a pump which meters precise quantities of liquid, unlike most prior art pumps.

SUMMARY OF THE INVENTION

The present invention fulfills this need in the art by providing an apparatus for pumping liquids including a body having an upper portion, a lower portion, an inlet in the upper portion and an outlet in the lower portion, whereby liquids may fall by gravity from the inlet to the outlet. The body has a gas injection port between the inlet and the outlet, and a valve between the gas injection port and the inlet, the valve being normally open, but closeable upon an injection of gas through the gas injection port. A gas injection apparatus is provided for injecting gas through the gas injection port from time to time. When no gas is being injected by the gas injection apparatus, liquid may enter the upper portion of the body through the inlet and fall by gravity toward the outlet in the lower portion. Upon injection of gas by the gas injection apparatus, the valve closes, trapping liquid in the body below the valve, and as gas continues to be injected by the gas injection apparatus, trapped liquid is forced out the outlet.

In a preferred embodiment the valve is a swing check valve. Preferably, the body has a crook between the valve and the gas injection port, which helps to assure that the pressure closes the valve.

Preferably, the gas injection apparatus injects gas at a pressure of at least about 40 psi. For some applications it is desirable to include a strainer mounted on the inlet to prevent large solids from entering the inlet, however one of the advantages of the invention is that small solids do not disrupt the pump operation and are transferred with the pumped liquid. The body may be provided with two of the valves between the inlet and the gas injection port, to increase the likelihood of closure of at least one of the valves during a gas injection even if solids prevent the closure of the other of the valves.

The apparatus may include a second valve downstream of the gas injection inlet to prevent pumped liquid from returning to the body through the outlet.

In one embodiment a sensor in the body ascertains when the body contains liquid instead of gas and is operatively connected to the gas injection apparatus to cause the gas injection apparatus to inject gas when the body contains liquid.

The invention may be carried out with a plurality of the bodies and gas injection apparatuses, with a manifold connected to the outlets of the bodies to receive and convey the pumped output of the plurality of bodies. The gas injection apparatuses may be arranged to inject gas simultaneously with one another. Alternatively, the gas injection apparatuses may be arranged so that they do not necessarily inject gas simultaneously with one another. If so, desirably, each of the bodies is provided with a second valve downstream of its gas injection inlet to prevent liquid pumped by one of the other bodies from returning through its outlet.

The valve at the inlet may include a buoyant flapper so that the valve closes when the body if filled with liquid. If so, the body may be provided with a sensor that senses the closure of the valve and is operatively connected to the gas injection apparatus to cause the gas injection apparatus to inject gas when the valve is closed.

An advantage of the invention is the fact that the pumping body need not be large, so that the pump may be located in small chambers. For example if the apparatus is to pump liquids to a destination through a pipe of a first cross-sectional area, the body may have a cross-sectional area less than twice the cross-sectional area of the pipe.

The invention also provides an apparatus for separating a mixture of immiscible liquids which include a heavier fraction and a light fraction. A settling container receives the mixture, and the heavier fraction separates from the lighter fraction and settles below the lighter fraction. The container has a discharge port for the heavy fraction defining a static topmost heavy fraction level, so by locating the inlet of the body at or above the topmost heavy fraction level, the lighter fraction maybe pumped off, leaving the heavy fraction to be discharged through the discharge port.

In another aspect, the invention provides a method of pumping liquids including providing a body having a check-valve-equipped inlet in its upper portion and an outlet in its lower portion, with the inlet located in a body of liquid to be pumped, so that liquids fall by gravity from the inlet to the outlet when the check valve is open. The method proceeds by the injection of gas through a port between the inlet and the outlet to close the valve and trap liquid in the body below the valve, and continues with further injection of gas through the port to force the trapped liquid to exit the body through the outlet. When the air injection ceases, the valve opens and air in the body may escape through the inlet and be replaced by another charge of liquid to be pumped.

Preferably, the gas injection step is carried out by injecting gas at a pressure of at least about 40 psi. The method may include straining inflow to the inlet to prevent large solids from entering the inlet. If the body has two valves between the inlet and the gas injection port, the gas injection step closes at least one of the valves even if solids prevent the closure of the other of the valves.

A preferred technique includes closing a second valve downstream of the gas injection inlet when gas is not being injected to prevent pumped liquid from returning to the body through the outlet.

The method may include sensing when the body contains liquid instead of gas and performing the gas injection step when the body contains liquid.

The method may be practiced with a plurality of the bodies and gas injection apparatuses, with a manifold connecting the outlets of the bodies with a destination. If so, the pumped output of the plurality of bodies is received in the manifold and conveyed through the manifold to the destination. Gas may be injected simultaneously in the plurality of bodies. Or, gas may be injected into the plurality of bodies non-simultaneously with the closing of a second valve in each body downstream of its gas injection inlet when it is not pumping to prevent liquid pumped by one of the other bodies from returning through its outlet.

In another aspect the method includes providing a body having an upper inlet, a check valve having a buoyant flapper and a lower outlet, with the inlet located in the liquid to be pumped so that liquids fall by gravity from the inlet to the outlet when the check valve is open, closing the valve by the buoyancy of the flapper when the body is filled with liquid, injecting gas through a port between the inlet and the outlet when the valve is closed to trap liquid in the body below the valve, and continuing to inject gas through the port to force the trapped liquid to exit the body through the outlet. This method may include sensing the closure of the valve and injecting gas when the valve is sensed as closed.

Furthermore, the invention provides a method of metering liquids including providing a body having a check-valve-equipped inlet in its upper portion, an outlet in its lower portion and a cavity of a predetermined volume between the inlet and outlet. The body is located so that the inlet is in the liquid to be metered, so liquid fills the cavity of the body by inflow from the inlet when the check valve is open. The method proceeds by injecting gas through a port between the inlet and the outlet to close the valve and trap liquid in the cavity below the valve, and continuing to inject gas through the port to force all of the liquid trapped in the cavity to exit the body through the outlet. The amount forced through the outlet can be ascertained as the volume of the cavity.

The method may include ceasing the gas injection to permit the valve at the inlet to open to permit additional liquid to enter the cavity through the inlet, followed by repeating the gas injection steps.

The invention also provides a method of pumping liquids, particularly suitable for hazardous or corrosive liquids, including providing a body having a check-valve-equipped inlet in its upper portion and an outlet in its lower portion, with the inlet located in the liquid to be pumped, so that liquids fall by gravity from the inlet to the outlet when the check valve is open, injecting gas through a port between the inlet and the outlet to close the valve and trap liquid in the body below the valve, and continuing to inject gas through the port to force all of the trapped liquid to exit the body through the outlet, without any residual puddles in the body.

The invention also provides a method of separating a mixture of immiscible liquids which include a heavier fraction and a light fraction. The mixture of immiscible liquids is introduced to a settling zone in which the heavier fraction separates from the lighter fraction and settles below the lighter fraction forming an interface at the boundary between the topmost heavy fraction level and the bottom-most light fraction level. A body having a check-valve-equipped inlet in its upper portion is located proximate the zone so that the inlet serves as a weir no lower than the topmost heavy fraction level. The lower portion of the body has an outlet, so that liquid of the lighter fraction falls by gravity from the inlet to the outlet when the check valve is open. Gas is injected through a port between the inlet and the outlet to close the valve and trap liquid of the lighter fraction in the body below the valve. The injection of gas through the port continues, to force the trapped liquid of the lighter fraction to exit the body through the outlet. Preferably, the weir is located at the topmost heavy fraction level.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
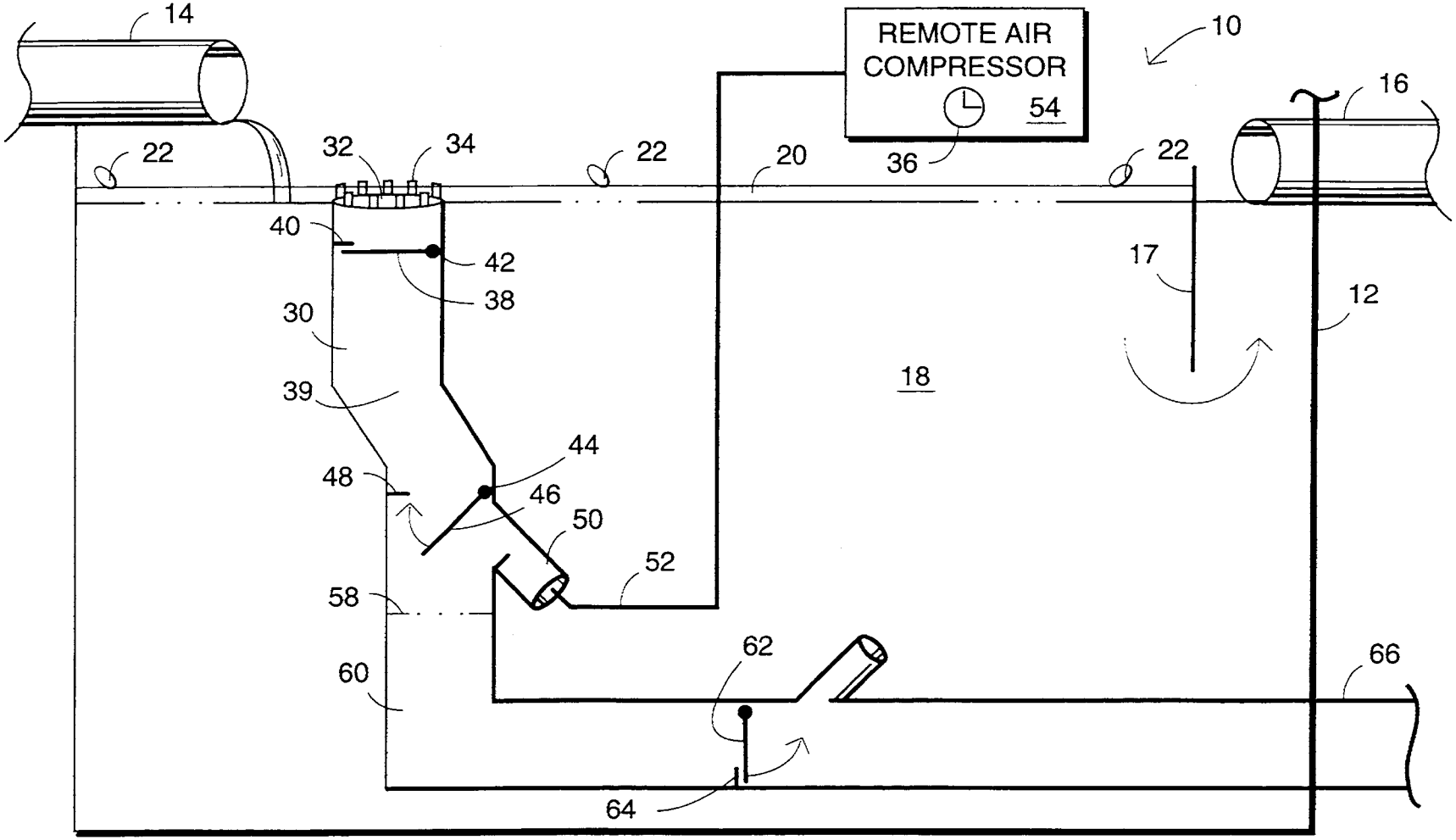
FIG. 1 is a schematic side view of a container using the pump of the present invention to serve to remove oil/grease from liquid held in the container.

Referring to FIG. 1, there is shown an apparatus 10 in accordance with the invention, suitable for removing oil/grease from a kitchen effluent. The apparatus 10 includes a holding or settling tank 12 into which the kitchen effluent drains from a pipe 14. In the tank 12, the heavy solids fall to the bottom under the body of water 18. The water 18 discharges from the tank 12 through a discharge pipe 16. A baffle 17 keeps oil/grease from passing to the discharge pipe 16. The bottom of the pipe 16 into which the water 18 drains defines the highest level the water can reach in tank 12. This can be described as a topmost heavy fraction level. Since the oil/grease is lighter than water, it will float on top of that level, forming the layer 20 seen in FIG. 1. Included with that layer 20 will be some lighter solids 22 which float on top of the water 18. Over time, most of those solids become water logged and sink to the bottom of the tank 12.

Disposed within the tank 12 is a body 30 having an upper inlet 32 forming a weir at or just above the topmost heavy fraction level. A plurality of upstanding strainer elements 34 around the weir prevent coarse solids 22 from falling into the inlet 32. However, the oil/grease 20 can enter the inlet 32, along with finer solids. The upper portion of the body 30 is nearly tubular in section, although the shape is not critical. The tubular shape is useful in order to provide a narrow diameter so that the body can be located at any desired place from which it is desired to pump. Within the body is a first check valve 38 hinged at hinge 42 and positioned to cooperate with a strike plate 40. When the valve 38 is raised against strike plate 40, the area below valve 38 is sealed from the area above it. As can be seen, preferably the valve 38 is located above a crook 39 in the body 30. The crook is not critical but helps assure that the pressure applied below the valve 38 is directed to close that valve, by directing the pressure upwardly through the liquid in the body.

A similar valve 46 is provided hinged at 44 with a complementary strike plate 48, with virtually the same characteristics as the valve 38. The body 30 has an outlet 58 leading to a conduit 60. Preferably, the conduit 60 also has a check valve 62 with a strike plate 64, and the conduit 66 exits the container 12 to carry off oil/grease from the conduit 60.

The body 30 has, below the valves 38 and 46 an air injection port 52 coupled with a remote air compressor 54 arranged so that the compressor 54 periodically supplies a pulse of air through the air injection port 52. The remote air compressor 54 may be actuated by one or more of various means, including a timer 36. Alternately, the compressor 54 may be actuated by responding to a sensed presence of oil/grease in the body 30, such as by the provision of a sensor within that body, or by any other desired means.

While air compressor 54 has been specifically described, of course, the air can be supplied from a stored, compressed air supply, rather than an active compressor. Also, although air is a preferred embodiment, other gases can be used, particularly if the liquid to be pumped is reactive with air.

In operation, as the effluent is deposited from the pipe 14 into the tank 12, the oil/grease and light solids float to the top of the water 18. Water passes under the baffle 17 and is free to exit through the discharge pipe 16, thus defining the topmost heavy fraction level. The oil/grease 20 and lighter solids 22 float on top of that level. With the body 30 located so as to form its weir at or above that level, the oil/grease falls into the inlet 32 and falls through the body 30 through the outlet 58 into the piping 60 and 66. When the piping is full, the liquid will back up into the body 30.

Then, upon the initiation of a pulse from the compressor 54 through the air injection port 52, one or both of the valves 38 and 46 will close against its respective strike plate 40 and 48, providing a sealed space below the closed valve. The continued application of compressed air from the compressor 54 forces the liquid under the valve down and out through the outlet 58, through the piping 60 and past the check valve 62. Then, the air supply from the compressor 54 through the port 52 can be terminated. It will be appreciated that the period of time of the air injection can be varied and is desirably selected so as to fully evacuate the liquid past the check valve 62. However, the exact configuration of the piping 60, 66, the location of the check valve 62, the variations in the diameter of the conduit 60 and the surface tension and viscosity of the liquid may vary how effectively the liquid can be passed horizontally along the pipe 66. Nonetheless, once the liquid has been forced an appreciable amount, the air injection can be terminated. Removal of the pressure under the valves 46 and 38 permits them to reopen so that additional liquid falling through the inlet 32 can pass in the lower portion of the body 30. A return flow of liquid in the conduit 60, 66 is prevented by the closure of the check valve 62. The air collected in the body 30 can bubble out through the inlet 32, past in the inrushing oil/grease.

Large solids 22 which might interfere with the closure of the valves 38 and 46 are kept out of the body 30 by the strainer elements 34. Smaller solids which pass through are typically not a problem because even if they prevent the sealing closure of one of the valves 38 or 46, typically the other valve will successfully close. Also, the solids typically fall through the body 30, past the outlet 58 and into the pipe 60, further reducing the possibility of clogging of the valves in the body 30.

Thus, relatively pure oil/grease, with some solids, is pumped along line 66, while water which is free of oil/grease exits the chamber 12 through the pipe 16.

Figure 2:
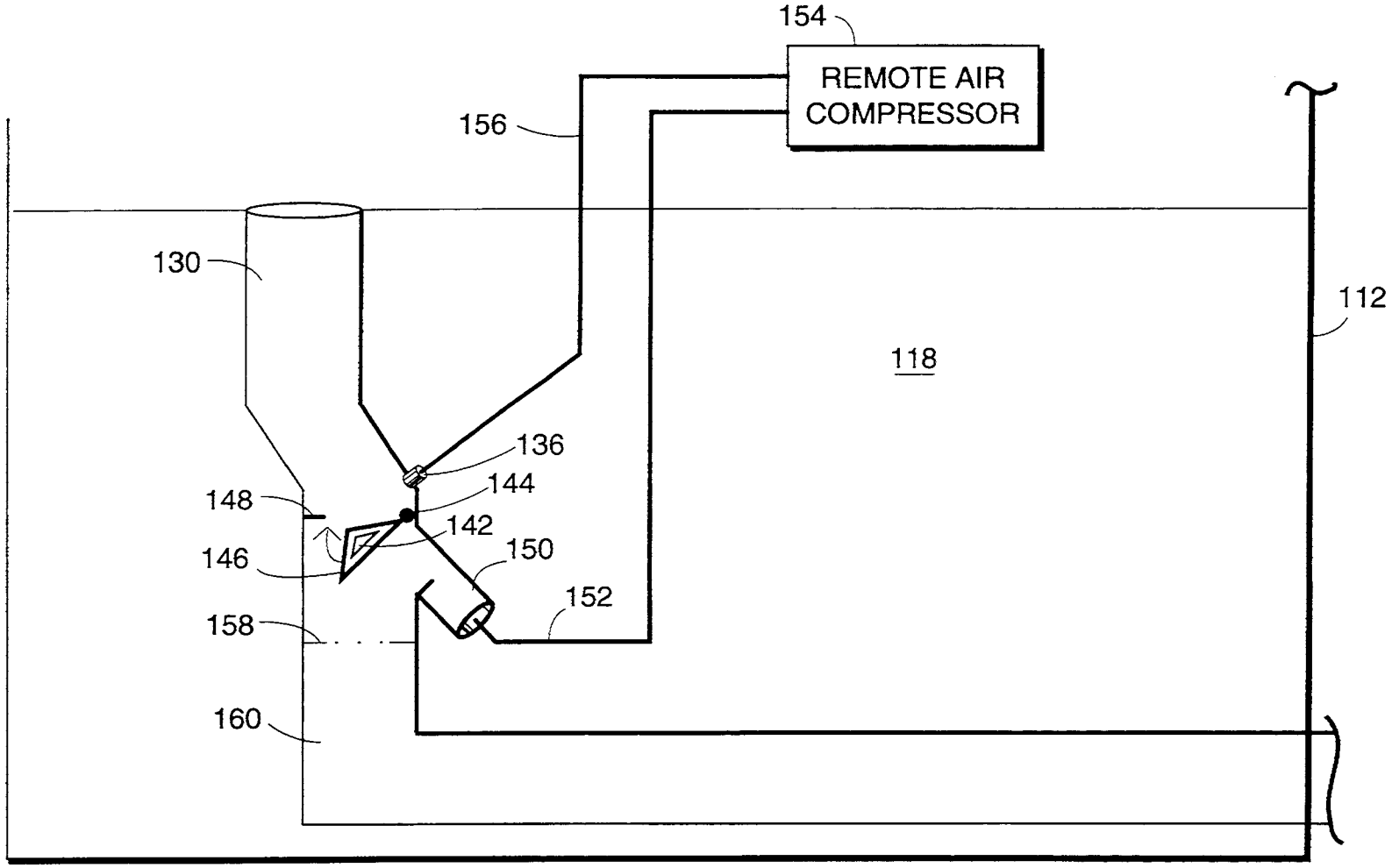
FIG. 2 is a view similar to the view of FIG. 1 of a second embodiment.

Turning now to FIG. 2, an alternate embodiment is shown. Similarly numbered elements are shown in FIG. 2 augmented by 100. In FIG. 2, the body 130 is shown disposed in a body of liquid 118 to be pumped. The embodiment shown in FIG. 2 is shown for general purpose pumping, but could be just as well located in the holding tank 12 shown in FIG. 1. Thus, the body 130 shown disposed in a body of any type of liquid 118, so that the upper portions of the body of liquid 118 can fall into the body 130 and through its outlet 158 into exit piping 160. In the embodiment depicted, only one valve 146 is provided, hinged at 144 and with a strike plate 148. Of course, two or more valves could be provided, if desired. The valve 146 is provided with a hollow portion 142, so that it is lighter than the liquid 118 to be pumped. Thus, as the body 130 fills with the liquid 118, the valve 146 floats up to be in sealing contact with the strike plate 148, so the valve is self closing. When the liquid level reaches a sensor 136, a signal is sent along line 156 to the remote air compressor 154 that a full charge of liquid has been received in the body 130. Various sensors can be used, velocity float-activated switches, capacitance sensors or the like. Remote air compressor 154 is designed to respond to the receipt of that signal along line 156 to output a pulse of air to the air injection port 152. The air supplied along injection port 152 presses the valve 156 against the strike plate 158 to assure a good seal and then, like before, forces the liquid below the valve, down, past the outlet 158 into the exit tubing 160. In the embodiment shown in FIG. 2, the downstream check valve has been omitted, although it can be included, if necessary to prevent liquid return. As before, the remote air compressor 154 can be a stored air tank, the gas can be other than air, and the control mechanism can be a timer or other type of control.

After the air injection has been halted, the valve 146 opens, permitting the air in body 130 to escape by bubbling up through inrushing liquid 118. Then, when the valve 146 again floats up against the strike plate 148 and the sensor 136 detects liquid, the cycle is resumed.

Figure 3:
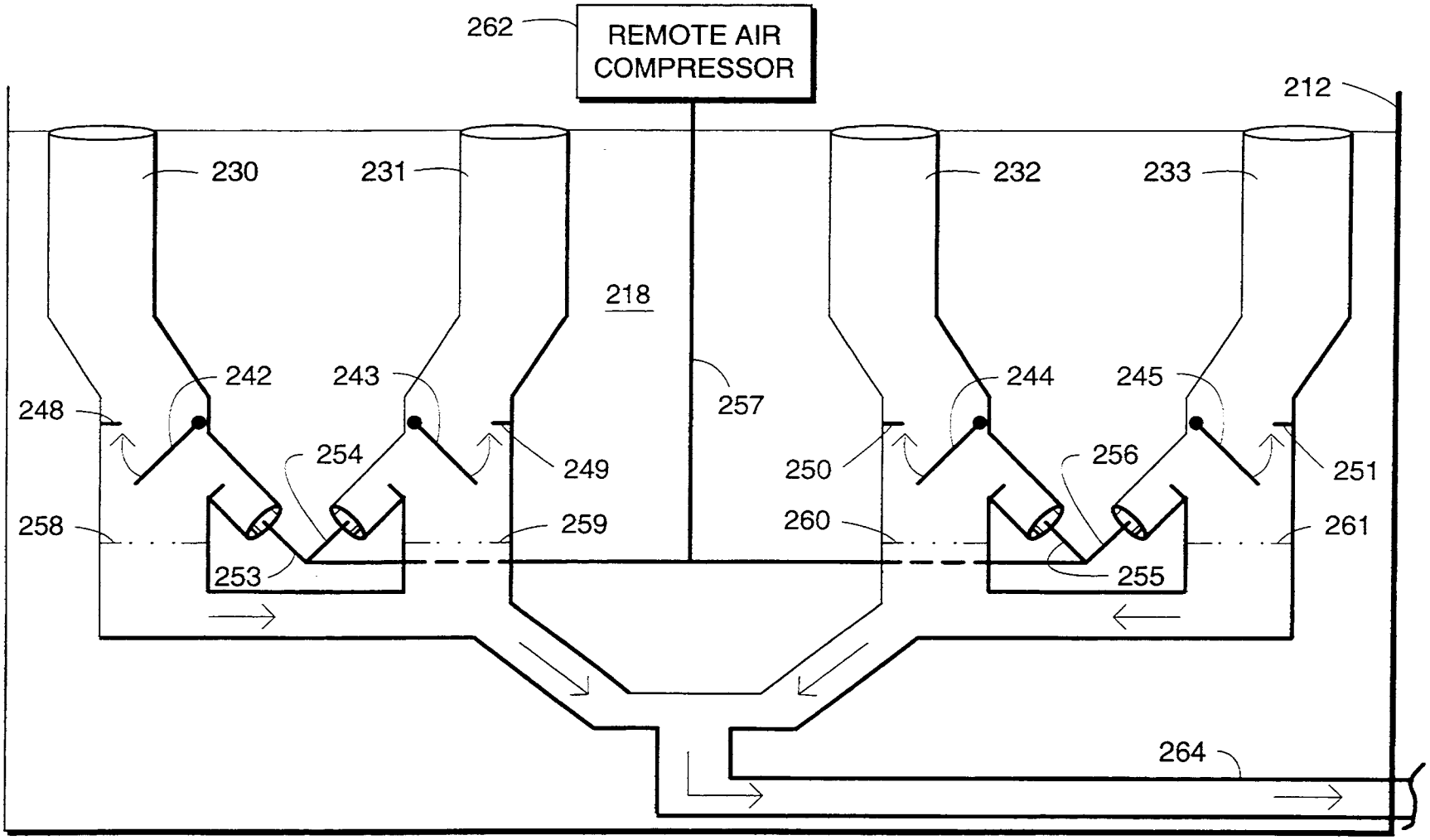
FIG. 3 is a view similar to the view of FIG. 1 of a third embodiment having multiple pump units.

Turning now to FIG. 3, an alternate embodiment using several bodies 230, 231, 232 and 233 is shown. The bodies are disposed within the liquid 21 8 to be pumped. Each, as before has an upwardly facing inlet and a lower outlet at 258, 259, 260 and 261, respectively. Each is also provided with a valve 242, 243, 244 and 245 with respective strike plate 248, 249, 250 and 251. Downstream of the outlets 258, 259, 260 and 261, the flows from the four bodies are merged in a common pipe 264. A common air compressor 262 supplies air along line 257 and branch lines 253, 254, 255 and 256 underneath the valves of the respective bodies, 230, 231, 232 and 233.

As before, the compressor 262 can be actuated in response to a timer or a sensor or some other actuation. Upon the application of the air injection pulses along the common lines, all four valves 242, 243, 244 and 245 close simultaneously, and the liquids are forced downwardly in the bodies 230, 231, 232 and 233 and into the pipe 264. When the pressure is relieved from the air compressor 262, all four valves open, and the cycle can resume. Obviously, the provision of the four bodies 230, 231, 232 and 233 permits the pumping of greater volumes of liquid than the single body embodiments shown in FIGS. 1 and 2. Of course, various other numbers of bodies other than the four specifically shown in FIG. 3 can be used.

Figure 4:
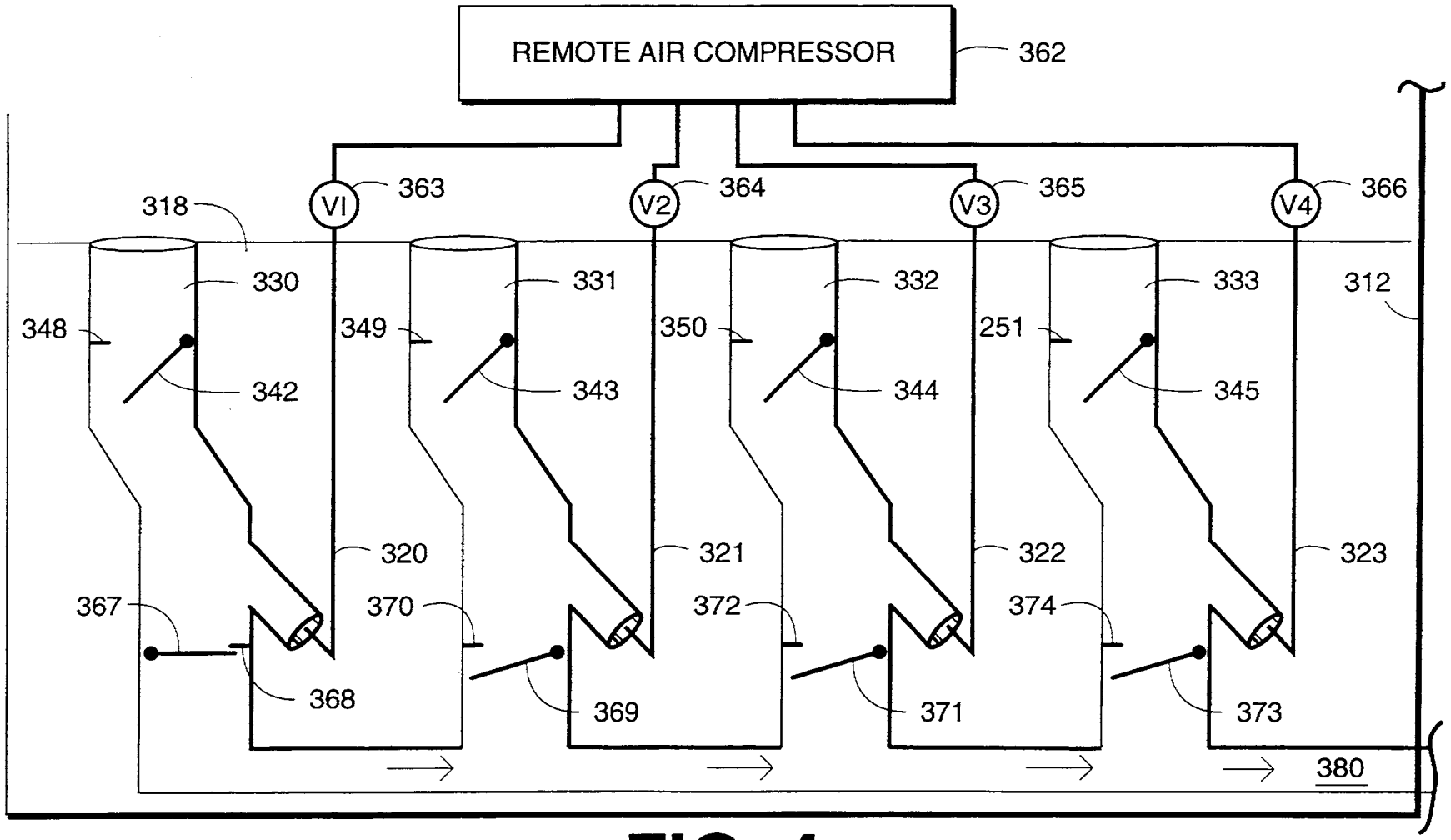
FIG. 4 is a view similar to the view of FIG. 3 of a fourth embodiment.

Referring now to FIG. 4, another embodiment having four bodies, 330, 331, 332 and 333, is shown. These bodies are disposed in a liquid 31 8 to be pumped. Each body is provided with a valve 342, 343, 344 and 345 with a respective strike plate 348, 349, 350 and 351. The four bodies merge their discharges into a common manifold pipe 380, but each is also provided with a reverse check valve. Thus, the valves 367, 369, 371 and 373 are provided with respective strike plates 368, 370, 372 and 374 to prevent back flows into the respective bodies from pressures in the common manifold 380.

The bodies are supplied with compressed air at an air injection inlets through separate pressure lines 320, 321, 322 and 323, all connected with compressor 362. However, the compressor 362 has separate outlet valves 363, 364, 365 and 366 connected to the lines 320, 321, 322 and 323, respectively. Thus, unlike the embodiment of FIG. 3, the air pressure for each body may be supplied at a different time than the other bodies. Therefore, when the valve 363 is open to supply compressed air along line 320 to the body 330 to close its valve 342, the liquid will be pumped down through the body 330 and past its open check valve 367 into the manifold 380. In order to prevent that liquid from backing into the bodies 331, 332, and 333, their respective check valves 369, 371 and 373 all close in response to the pressure in the manifold 380. Then, when the pressure is relieved on line 320 and substituted on, for example line 321, the check valve 367 will close and valve 369 will open so that the liquid can be pumped out of the body 331 and into the manifold 380.

The sequence and timing of the application of the pressures along the various lines 320, 321, 322 and 323 can be as desired. In fact, the pressure can be applied along multiple ones of those lines simultaneously, if desired. Thus, each may be actuated in response to a sensor in its respective body indicating the presence of liquid to be pumped out, like the sensor 136 shown with respect to FIG. 2. This will result in relatively random timing of the liquids being pumped out of the various bodies 330, 331, 332 and 333, including the possible incidental overlap of pumping through multiple bodies simultaneous.

Of course, the invention can be implemented using various numbers of bodies and various control mechanisms for timing when to supply the compressed air.

The buoyant valve closures shown in FIG. 2 can be used in any of the embodiments shown in FIGS. 1 through 4.

Since the body housing the valve is a very simple apparatus, it need not be very large and, in fact, can be of virtually the same diameter as the piping through which it discharges. This provides the advantage that the pump can be located in small areas and still perform an effective job. Also, since the pump can be made in a small size, a relatively high pressures can be applied using the air injection pressure, such as, desirable pressures of 40 pounds per square inch to quickly clear out the liquid in the body. Since the valve is small, it can adequately handle large pressure without due bulk. Applicant's pump is natively suited to higher working pressures with thinner wall cross sections than previously known pumps.

Preferred materials for the bodies and their valves are brass, although other materials, such as plastics or any other material suitable to withstand the environment in which it is to be placed may be used. The pump, and especially the embodiment shown in FIG. 2, is suitable for use as a metering device. The within the body under the valve is known, so that a complete clearing of that volume will move an equal volume of liquid through the outlet piping. By monitoring the number of times the apparatus is actuated and multiplying that number times the known volume, a precise measure of the volume of liquid pumped can be determined. Thus, the apparatus can be used as a metering pump.

Since virtually all of the liquid in the pump will fall out through the outlet, the pump of the present invention is useful with corrosive or hazardous liquids, since there will be no residual liquid in the pump after the last pumping cycle. No extra effort is required to drain the corrosive or hazardous liquid from the pump after use.

Similarly, since the bottom of the pump is open, any solids which may enter the pump will simply fall through and not result in malfunctioning of the pump.

Finally, because there are no close tolerances to be maintained in applicant's invention, various liquids can be readily be pumped, including those containing gritty material, viscous liquid, and the like.

The invention has the further advantages of being very low cost, with a very simple design. Should the pump be run without any liquid, there will be no damage to the pump.

If desired, the pump could even be used for flowing powders, sands and slurry. The pump need not be immersed in the liquid, but could be attached to a drain or be located in a drain line.

Those of ordinary skill in the art will appreciate that the invention can be carried out in various modifications to the specifically described embodiments, and those are all deemed to be within the scope of applicants invention.

What is claimed is:

1. An apparatus for pumping liquids comprising a body having an upper portion, a lower portion, an inlet in said upper portion and an upwardly open outlet in said lower portion, whereby liquids fall by gravity from said inlet to and through said outlet, a gas injection port between said inlet and said outlet, and a valve between said gas injection port and said inlet, said valve being normally open, but closeable upon an injection of gas through said gas injection port, and a gas injection apparatus for periodically injecting gas through said gas injection port, whereby when no gas is being injected by said gas injection apparatus, liquid enters said upper portion of said body through said inlet and falls by gravity to and through said outlet in said lower portion, upon injection of gas by said gas injection apparatus, said valve closes, trapping liquid in said body below said valve, and as gas continues to be injected by said gas injection apparatus, trapped liquid is forced out said outlet.

2. An apparatus as claimed in claim 1 wherein said valve is a swing check valve.

3. An apparatus as claimed in claim 1 wherein said gas injection apparatus injects gas at a pressure of at least 40 psi.

4. An apparatus as claimed in claim 1 further comprising a strainer mounted on said inlet to prevent large solids from entering said inlet.

5. An apparatus as claimed in claim 1 further comprising a second valve downstream of said gas injection port to prevent pumped liquid from returning to said body through said outlet.

6. An apparatus as claimed in claim 1 further comprising a sensor in said body to ascertain when said body contains liquid instead of gas and operatively connected to said gas injection apparatus to cause said gas injection apparatus to inject gas when said body contains liquid.

7. An apparatus as claimed in claim 1 wherein said body has two of said valves between said inlet and said gas injection port, to increase the likelihood of closure of at least one of said valves during a gas injection through said gas injection port even if solids prevent the closure of the other of said valves.

8. An apparatus as claimed in claim 1 wherein said valve includes a buoyant flapper so that the valve closes when the body is filled with liquid and further comprising a sensor to sense the closure of said valve and operatively connected to said gas injection apparatus to cause said gas injection apparatus to inject gas when said valve is closed.

9. An apparatus as claimed in claim 1 wherein said gas injection apparatus includes a device to inject gas for a period long enough to clear liquid from said body below said valve, but not substantially longer.

10. An apparatus as claimed in claim 1 wherein said body has a crook between said valve and said gas injection port, whereby the likelihood of closing said valve upon injection of gas by said gas injection apparatus increases.

11. An apparatus as claimed in claim 1 comprising a plurality of said bodies and gas injection apparatuses, with a manifold connected to said outlets of said bodies to receive and convey the pumped output of said plurality of bodies.

12. An apparatus as claimed in claim 11 wherein said gas injection apparatuses inject gas simultaneously with one another.

13. An apparatus as claimed in claim 11 wherein said gas injection apparatuses do not inject gas simultaneously with one another and each of said bodies is provided with a second valve downstream of its gas injection inlet to prevent liquid pumped by one of the other bodies from returning through its outlet.

14. A method of pumping liquids comprising providing a body having a check-valve-equipped inlet in its upper portion and an outlet in its lower portion with the inlet in a body of liquid to be pumped, so that liquids fall by gravity from the inlet to the upwardly open outlet when the check valve is open, injecting gas through a port between the inlet and the outlet to close the valve and trap liquid in the body below the valve, and continuing to inject gas through the port to force the trapped liquid to exit the body through the outlet.

15. A method as claimed in claim 14 wherein the gas injection step includes injecting gas at a pressure of at least 40 psi.

16. A method as claimed in claim 14 further comprising straining inflow to the inlet to prevent large solids from entering the inlet.

17. A method as claimed in claim 14 further comprising closing a second valve downstream of the gas injection port when gas is not being injected to prevent pumped liquid from returning to the body through the outlet.

18. A method as claimed in claim 14 further comprising sensing when the body contains liquid instead of gas and performing said gas injection step when the body contains liquid.

19. A method as claimed in claim 14 wherein the body has two valves between the inlet and the gas injection port, and the gas injection step closes at least one of the valves even if solids prevent the closure of the other of the valves.

20. A method of pumping liquids as claimed in claim 14 further comprising continuing to inject gas through the port to force all of the trapped liquid to exit the body through the outlet, without any residual puddles in the body.

21. A method as claimed in claim 14 further comprising ceasing the air injection to permit the valve to open and allowing air in the body to escape through the inlet.

22. A method as claimed in claim 14 practiced with a plurality of the bodies and gas injection apparatuses, with a manifold connecting the outlets of the bodies with a destination comprising receiving the pumped output of the plurality of bodies in the manifold and conveying outputs through the manifold to the destination.

23. A method as claimed in claim 22 comprising injecting gas simultaneously in the plurality of bodies.

24. A method as claimed in claim 25 comprising injecting gas into the plurality of bodies non-simultaneously and closing a second valve in each body downstream of its gas injection inlet when gas is not being injected into that body to prevent liquid pumped by one of the other bodies from returning through its outlet. pumped so that liquids fall by gravity from the inlet to the outlet when the check valve is open, closing the valve by the buoyancy of the flapper when the body is filled with liquid, injecting gas through a port between the inlet and the outlet when the valve is closed to trap liquid in the body below the valve, and continuing to inject gas through the port to force the trapped liquid to exit the body through the outlet.

25. A method of pumping liquids comprising providing a body having an upper inlet, a check valve having a buoyant flapper and a lower outlet, with the inlet in a body of liquid to be pumped so that liquids fall by gravity from the inlet to the upwardly open outlet when the check valve is open, closing the valve by the buoyancy of the flapper when the body is filled with liquid, injecting gas through a port between the inlet and the outlet when the valve is closed to trap liquid in the body below the valve, and continuing to inject gas through the port to force the trapped liquid to exit the body through the outlet.

26. A method as claimed in claim 25 further comprising sensing the closure of the valve and injecting gas when the valve is sensed as closed.

27. A method of pumping liquids comprising providing a body having an inlet in the upper portion and an outlet in the lower portion and two check valves between the inlet and outlet, with the inlet in a body of liquid to be pumped, so that liquids fall by gravity from the inlet to the outlet when the check valves are open, straining inflow to the inlet to prevent large solids from entering the inlet, injecting gas at a pressure of at least 40 psi through a port between the check valves and the outlet to close at least one of the valves even if solids prevent the closure of the other of the valves and to trap liquid in the body below the closed valve, continuing to inject gas through the port to force the trapped liquid to exit the body through the outlet, ceasing the gas injection and permitting the valves at the inlet to open to permit liquid to enter the body through the inlet, and closing a third valve downstream of the gas injection inlet when gas is not being injected to prevent pumped liquid from returning to the body through the outlet.

28. A method as claimed in claim 27 further comprising sensing when the body contains liquid instead of gas and performing said gas injection step when the body contains liquid.

29. An apparatus for pumping liquids to a destination comprising a pipe of a first cross-sectional area extending from a vessel containing the liquid to be pumped to said destination, a body having a cross-sectional area less than twice said first cross-sectional area and having an upper portion, a lower portion, an inlet in said upper portion and an upwardly open outlet to said pipe in said lower portion, whereby liquids fall by gravity from said inlet to and through said outlet, a gas injection port between said inlet and said outlet, and a valve between said gas injection port and said inlet, said valve being normally open, but closeable upon an injection of gas through said gas injection port, and a gas injection apparatus for periodically injecting gas through said gas injection port, whereby when no gas is being injected by said gas injection apparatus, liquid enters said upper portion of said body through said inlet and falls by gravity to and through said outlet in said lower portion and said pipe, upon injection of gas by said gas injection apparatus, said valve closes, trapping liquid in said body below said valve, and as gas continues to be injected by said gas injection apparatus, trapped liquid is forced out said outlet and into said pipe toward said destination.

30. An apparatus for pumping liquids to a destination comprising a pipe of a first cross-sectional area extending from a vessel containing the liquid to be pumped to said destination, a body having a cross-sectional area less than twice said first cross-sectional area and having an upper portion, a lower portion, an inlet in said upper portion and an outlet to said pipe in said lower portion and including a strainer mounted on said inlet to prevent large solids from entering said inlet, whereby liquids fall by gravity from said inlet to said outlet but large solids are excluded, a gas injection port between said inlet and said outlet, and a pair of swing check valves between said gas injection port and said inlet, said valves being normally open, but closeable upon an injection of gas through said gas injection port, a gas injection apparatus for periodically injecting gas through said gas injection port at a pressure of at least 40 psi, and a third valve downstream of said gas injection inlet to prevent pumped liquid from returning to said body through said outlet, whereby when no gas is being injected by said gas injection apparatus, liquid may enter said upper portion of said body through said inlet and fall by gravity toward said outlet in said lower portion, but already pumped liquid is prevented from returning to said body by said third valve, upon injection of gas by said gas injection apparatus, said valve closes, trapping liquid in said body below said valve, and as gas continues to be injected by said gas injection apparatus, trapped liquid is forced out said outlet and into said pipe toward said destination.

31. An apparatus for pumping liquids comprising a body having an upper portion, a lower portion, an inlet in said upper portion and an outlet in said lower portion, whereby liquids fall by gravity from said inlet to said outlet, a gas injection port between said inlet and said outlet, and a valve between said gas injection port and said inlet, said valve being normally open, but closeable upon an injection of gas through said gas injection port, and a gas injection apparatus for injecting gas through said gas injection port, whereby when no gas is being injected by said gas injection apparatus, liquid may enter said upper portion of said body through said inlet and fall by gravity toward said outlet in said lower portion, upon injection of gas by said gas injection apparatus, said valve closes, trapping liquid in said body below said valve, and as gas continues to be injected by said gas injection apparatus, trapped liquid is forced out said outlet, wherein said body has two of said valves between said inlet and said gas injection port, to increase the likelihood of closure of at least one of said valves during a gas injection through said gas injection port even if solids prevent the closure of the other of said valves.

32. An apparatus for pumping liquids comprising a body having an upper portion, a lower portion, an inlet in said upper portion and an outlet in said lower portion, whereby liquids fall by gravity from said inlet to said outlet, a gas injection port between said inlet and said outlet, and a valve between said gas injection port and said inlet, said valve being normally open, and a gas injection apparatus for injecting gas through said gas injection port, whereby when no gas is being injected by said gas injection apparatus, liquid may enter said upper portion of said body through said inlet and fall by gravity toward said outlet in said lower portion, upon injection of gas by said gas injection apparatus, said valve closes, trapping liquid in said body below said valve, and as gas continues to be injected by said gas injection apparatus, trapped liquid is forced out said outlet, wherein said valve includes a buoyant flapper so that the valve closes when the body if filled with liquid and further comprising a sensor to sense the closure of said valve and operatively connected to said gas injection apparatus to cause said gas injection apparatus to inject gas when said valve is closed.

33. An apparatus for pumping liquids comprising a body having an upper portion, a lower portion, an inlet in said upper portion and an outlet in said lower portion, whereby liquids fall by gravity from said inlet to said outlet, a gas injection port between said inlet and said outlet, and a valve between said gas injection port and said inlet, said valve being normally open, but closeable upon an injection of gas through said gas injection port, and a gas injection apparatus for injecting gas through said gas injection port, whereby when no gas is being injected by said gas injection apparatus, liquid may enter said upper portion of said body through said inlet and fall by gravity toward said outlet in said lower portion, upon injection of gas by said gas injection apparatus, said valve closes, trapping liquid in said body below said valve, and as gas continues to be injected by said gas injection apparatus, trapped liquid is forced out said outlet, wherein said body has a crook between said valve and said gas injection port, whereby the likelihood of closing said valve upon injection of gas by said gas injection apparatus increases.

34. A method of pumping liquids comprising providing a body having a check-valve-equipped inlet in its upper portion and an outlet in its lower portion with the inlet in a body of liquid to be pumped, so that liquids fall by gravity from the inlet to the outlet when the check valve is open, injecting gas through a port between the inlet and the outlet to close the valve and trap liquid in the body below the valve, and continuing to inject gas through the port to force the trapped liquid to exit the body through the outlet, wherein the body has two valves between the inlet and the gas injection port, and the gas injection step closes at least one of the valves even if solids prevent the closure of the other of the valves.

35. A method of pumping liquids comprising providing a body having an upper inlet, a check valve having a buoyant flapper and a lower outlet, with the inlet in a body of liquid to be pumped so that liquids fall by gravity from the inlet to the outlet when the check valve is open, closing the valve by the buoyancy of the flapper when the body is filled with liquid, sensing the closure of the valve and injecting gas when the valve is sensed as closed through a port between the inlet and the outlet when the valve is closed to trap liquid in the body below the valve, and continuing to inject gas through the port to force the trapped liquid to exit the body through the outlet.

* * * * *